United States Patent [19]

Stella et al.

[11] 4,412,269

[45] Oct. 25, 1983

[54] LOCK OUT MEANS IN IGNITION DEVICES FOR LIQUID FUEL BURNERS

[75] Inventors: Antonio Stella; Giuseppe Canova, both of Legnago, Italy

[73] Assignee: R.B.L. Riello Bruciatori Legnago S.p.A., Legnago, Italy

[21] Appl. No.: 233,763

[22] Filed: Feb. 12, 1981

[30] Foreign Application Priority Data

Mar. 14, 1980 [IT] Italy ..... 20672 A/80

[51] Int. Cl.[3] ..... F23Q 9/14

[52] U.S. Cl. ..... 361/263; 431/258

[58] Field of Search ..... 361/253, 256, 263; 315/209 M, 209 R; 431/258, 45

[56] References Cited

U.S. PATENT DOCUMENTS

| | | | |
|---|---|---|---|
| 3,260,299 | 7/1966 | Lister | 361/263 |
| 3,673,436 | 6/1972 | Adams, Jr. | 361/263 |
| 4,073,611 | 2/1978 | Kaduki et al. | 431/45 |

*Primary Examiner*—C. C. Shaw

*Attorney, Agent, or Firm*—Wenderoth, Lind & Ponack

[57] ABSTRACT

A liquid fuel burner ignition device which includes a lock out device, having a bimetallic lamina or similar element, and an ignition transformer. The bimetallic lamina is so positioned as to be heated by electromagnetic induction, due to the effect of parasitic current induced therein by the flux of the ignition transformer. The ignition device is provided with a resistor which is adapted so as to also heat the bimetallic lamina.

7 Claims, 4 Drawing Figures

LOCK OUT MEANS IN IGNITION DEVICES FOR LIQUID FUEL BURNERS

BACKGROUND OF THE INVENTION

The present invention refers to improvements in ignition devices for liquid fuel burners and to control apparatus for said burners which incorporates said improvements.

The invention particularly refers to a burner control apparatus as described in Italian patent application No. 30885 A/75 of the applicant. Essentially, said apparatus comprises a motor actuated by a means which generates a heat request signal, a fan for feeding air to the burner, a pump for feeding liquid fuel to the burner, a valve means which in a "closed" position so as to inhibit the flow of liquid fuel from the pump to the burner and which is in an "open" position so as to permit such a flow of fuel, a means for producing a spark for igniting the liquid fuel which flows out of the burner, which ignition means comprises ignition electrodes fed by the secondary winding of a high frequency ignition transformer, and means for feeding the primary winding of said transformer with a low voltage of a high frequency. Said means for feeding the primary winding of the transformer comprises an oscillating circuit which in turn is fed a unidirectional current. Said unidirectional current is in turn obtained by rectifying an alternating current, generally having a low frequency, usually of the line frequency, and preferably derived from the motor winding.

Summing up, therefore, a low voltage of a low frequency, generally of the line frequency, is rectified so as to obtain a unidirectional low voltage, and said recrified low voltage is fed to an oscillating circuit which produces a low alternating voltage of a high frequency with which the primary winding of a transformer is fed, the secondary winding of which furnishes a high voltage of a high frequency current to the electrodes for the production of the spark used for igniting the fuel.

Furthermore, the invention is also applicable to ignition devices which are different from that described in said patent application, as will appear hereinafter and within the limits of which will be specified.

In the control boxes for burners in general, and more particularly in the one described hereinbefore, a so called lock out relay is included, the function of which is to stop the operation of the burner by stopping the feed thereto if the flame is not formed after a certain predetermined time, or if, once the flame has disappeared during the operation and the ignition cycle has been repeated, the flame is not formed anew. Said lock out relay comprises in general, and in the case which is relevant here, a bimetallic lamina (or analogous element) which, when heated by a winding through which current flows, becomes gradually deformed with the passage of time until, when a predetermined period of time has passed and if the flame has not formed and therefore the current has not ceased to pass through the heating winding, it interrupts in a suitable way the electrical feed circuit of the burner (i.e.-locks out the burner).

Obviously, the time required by the bimetallic lamina to become deformed to the extent necessary to cause the lock out depends, non-linearly, on the intensity of the current which flows through the heating winding. In the type of device to which the present invention applies, as previously recalled, said current—as that will better be seen hereinafter—is practically the same as absorbed by the aforesaid oscillating circuit—except that the rectifier intervenes—and is anyway closely related to the length of the spark, viz. to the distance between the ignition electrodes. Substantially the same current is therefore applied both to said winding and to said oscillating circuit and therefore to the ignition transformer. The current which flows through the winding is therefore at a maximum when the electrodes are correctly positioned, which occurs in practice when they are at a distance of about 4 mm apart from one another and the current decreases if they are displaced from the optimal position. This causes insecurity in the operation of the lock out device, because the blocking time may vary according to the position of the electrodes. Said variations of the blocking time may render the apparatus insufficiently safe.

SUMMARY OF THE INVENTION

The object of the presnt invention is to eliminate said drawback and to cause the blocking time to remain within acceptable safety limits even when the mutual position of the electrodes varies.

The object of the invention is achieved by a particular positioning of the bimetallic lamina and the respective winding of the lock out relay. More specifically, the device according to the invention is characterized in that the bimetallic lamina (or analogous element) is arranged in the ignition device in such a position that it is heated by electromagnetic induction, viz. by the parasitic current induced directly therein by the flux from the ignition transformer. Said heating is added to that normally provided by a heating resistance.

Specifically such positioning implies the positioning of the bimetallic lamina in the immediate vicinity of one end of the ferrite core which provides the magnetic coupling between the primary and secondary windings of the ignition transformer.

In the transformers employed in the ignition devices of the type to which the invention relates, since a simple ferrite bar is used to couple the primary and secondary windings of the ignition transformer, the flux of said transformer is closed externally through the air, whereby a substantial dispersion occurs. Since the frequency of the transformer is several thousands of Hz and usually about 20 kHz, the flux through the lamina is at the minimum under normal conditions, i.e. when the ignition electrodes are correctly positioned, but the flux increases if the electrodes are displaced from such a a position. Therefore, when their positioning is not correct, the current which flows through the heating winding of the lock out relay decreases on the one hand, but the direct heating of the bimetallic lamina by magnetic induction increases, because the flux of the transformer which produces said magnetic induction with the formation of parasitic current, increases. It may be said that a high frequency heating overlaps the conduction heating through the heating winding, the former heating increasing with the decreasing of the latter. Said increase does not rigorously compensate for the decrease of the conduction heating, but compensates for it to a degree which is substantial and quite adequate for the technical requirements. Practically, it may be said that taking into account the possible position irregularities of the ignition electrodes in this kind of device, the blocking time according to the previous state of the art could vary by a ratio of from 1 to 3, whereas when the present invention is used the ratio betweem maximum and minimum time decreases to 1.5, which signifies a variation that is acceptable and therefore the security of the ignition device does not become inadequate.

BRIEF DESCRIPTION OF THE DRAWINGS

An embodiment of the invention will now be described for exemplification purposes and not for limitation purposes, with reference to the attached drawings wherein.

Figure 2:
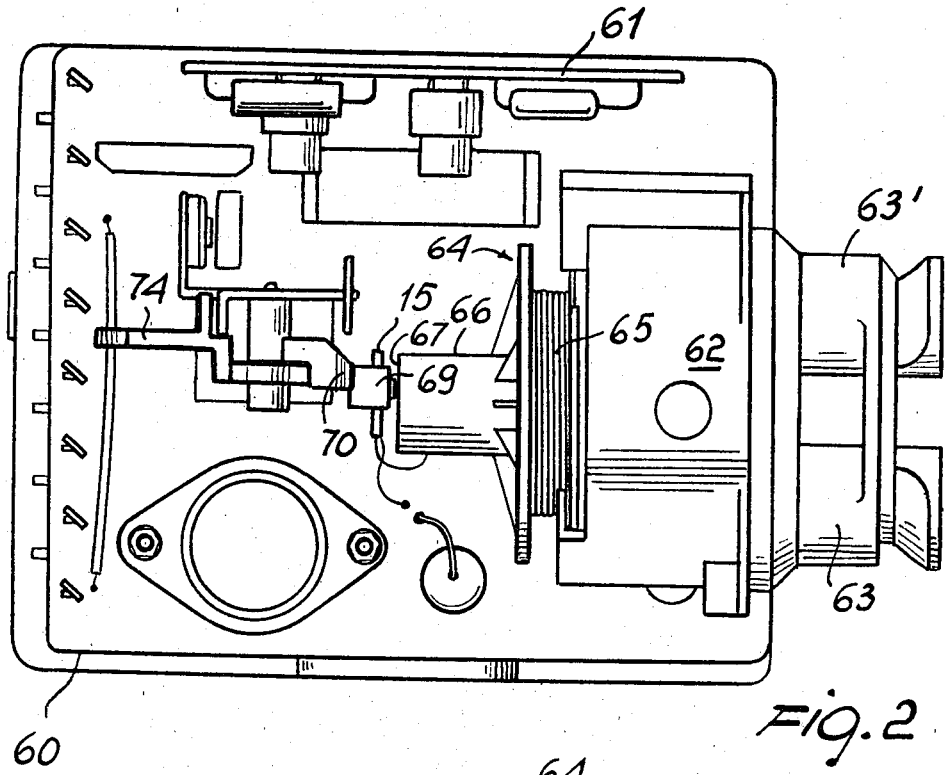
Figure 4:
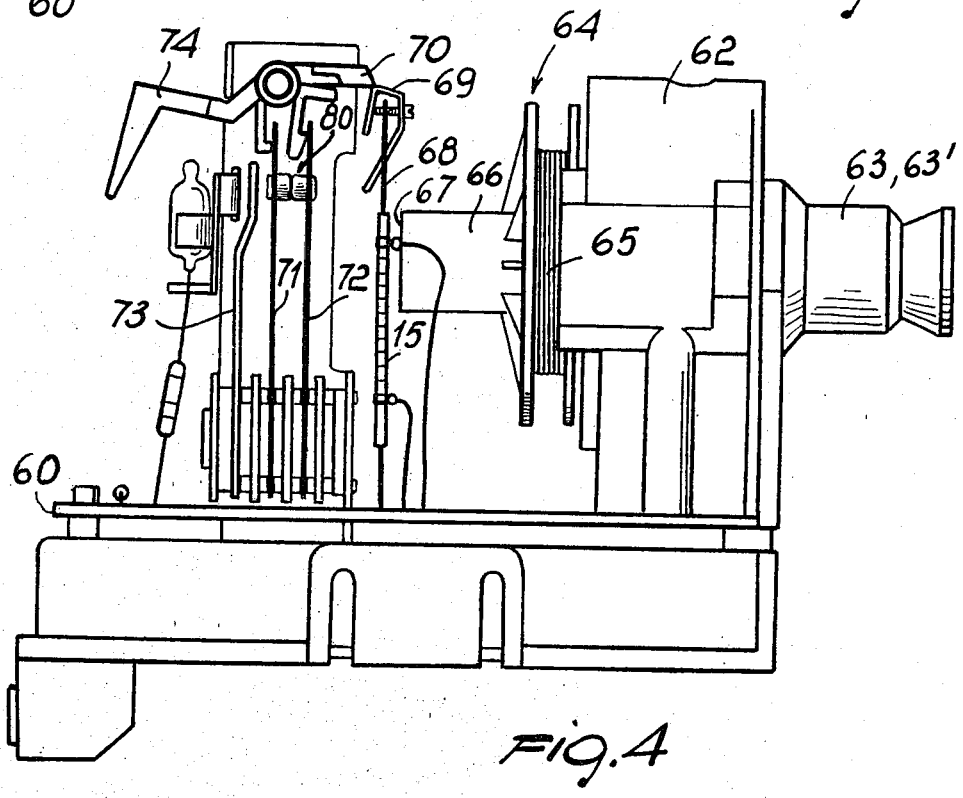
Figure 3:
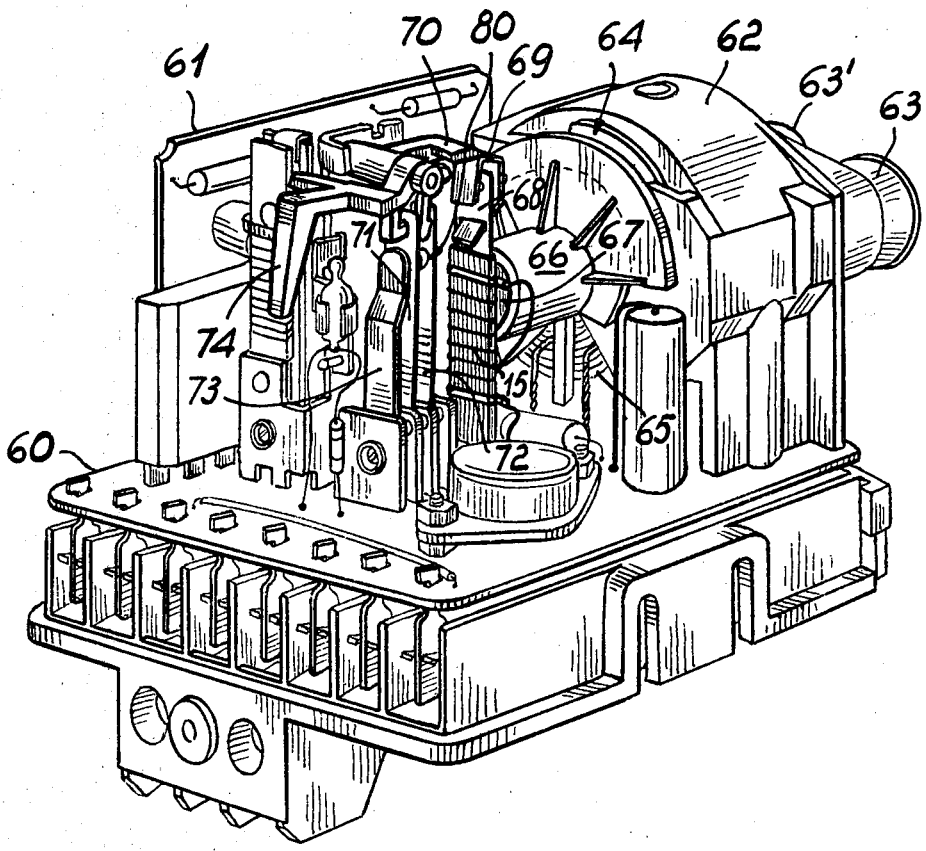

U.S. Application Ser. No. 233,761 filed Feb. 12, 1981, now U.S. Pat. No. 4,403,943;

FIGS. 2, 3, and 4 respectively represent, in plane view, in perspective, and in side elevation, a device incorporating an embodiment of the invention.

DESCRIPTION OF THE PREFERRED EMBODIMENT

Figure 1:
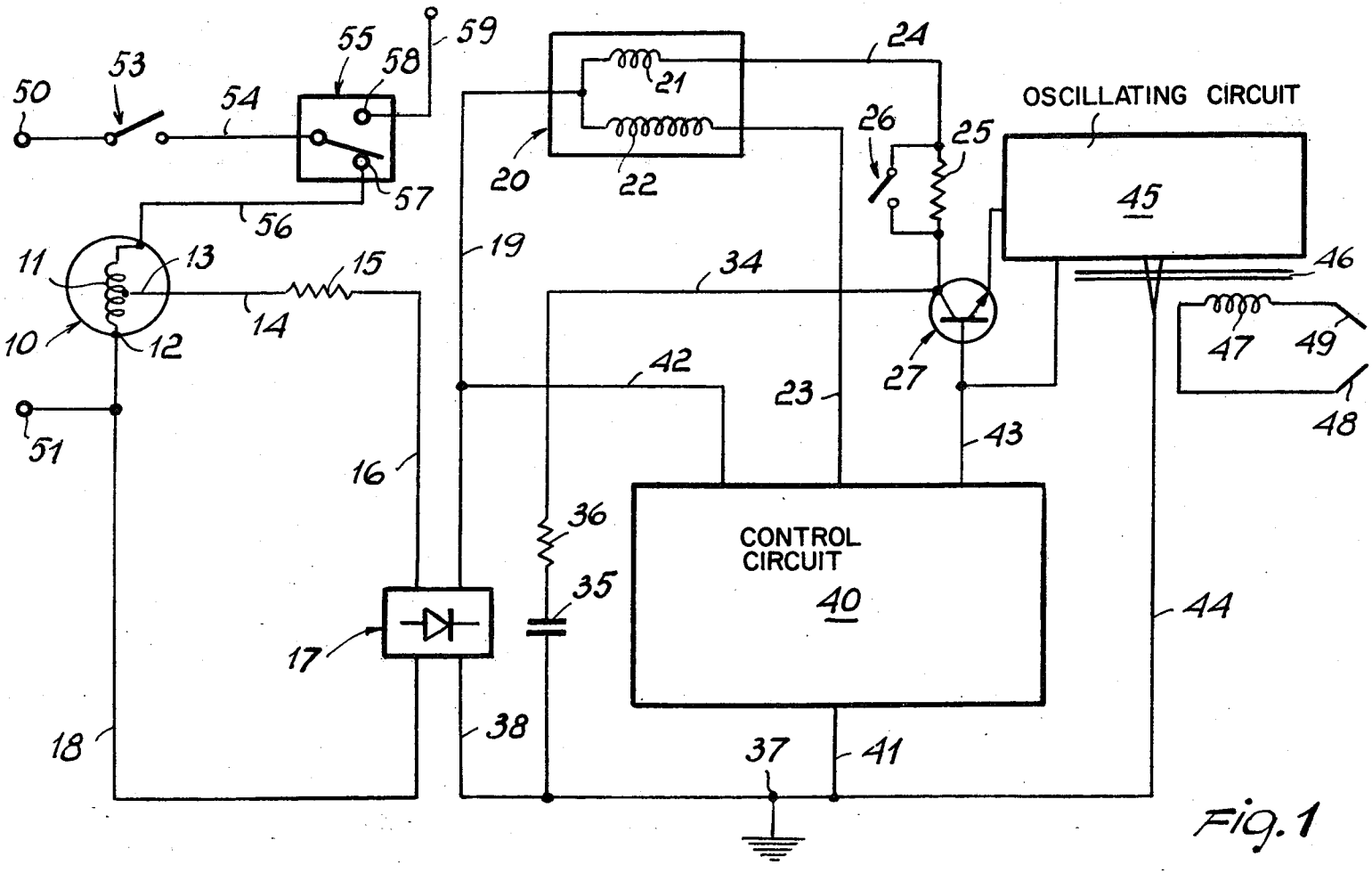
FIG. 1 schematically represents the circuit of a heating device to which said embodiment is applied, wherein blocks indicate the parts which are not related to the invention and which may have any suitable structure and e.g. may be such as described in the cited previous patent application of the Applicant or in the copending application of the same applicant having the title: "Improvements in the flame detection means in burner ignition devices"

With reference now to FIG. 1, numeral 10 indicates the motor of the ignition device and the winding 11 from which a low voltage of line frequency is derived. Said low voltage is derived from between terminal 12 and terminal 13 and therefore, the value of the voltage may be predetermined, when constructing the motor, since said motor acts as an auto-transformer. The current flows through conductor 14 to resistor 15 which is the heating winding of the lock out thermal relay, and then flows through conductor 16, rectifier 17, and returns to terminal 12 through conductor 18; the current then becomes inverted and flows through the same parts in the opposite sense. The rectified current which output from, rectifier 17 passes through conductor 19 to an electrically operated valve 20 having an excitation winding 21 and a retaining winding 22. Said valve is not a part of the invention and is a normal element in apparatus of this kind, and has also been described in the previous cited patent application of the applicant. The excitation winding serves to enable the feeding of fuel to the burner once the pre-ventilation phase has ended, whereas the retaining winding serves to maintain the valve in its permanently on position if the flame is formed within the predetermined time interval. The retaining winding is connected through conductor 23 to other apparatus which are part of the burner control device but do not affect the present invention, since they may have any appropriate structure, and may comprise e.g. a photoresistance for controlling the flame and means for the transmission of control signals to the ignition circuit and to the valve depending on the presence or absence of the flame and of its intensity and so forth, to determine the end of the ignition and/or of the fuel feed or the repetition of the ignition cycle, according to the case. Therefore, all these elements together are indicated only as a control circuit 40. When the rectified current passes through the retaining winding, the igntion device does not operate because the flame has already been formed and exists, and consequently, a phase which does not relate to the present invention is in course. The control circuit 40 is respectively connected by conductors 41,42 and 43 to the common ground 37 of the circuit, to conductor 19 which leads to the terminal of rectifier 17 and to oscillating circuit 45 which will be discussed later. From the excitation winding 21, the current passes through conductor 24. When the ignition has not yet begun, the device is in the prepurging stage, which is the first operative stage of the control device; once the device has received the heat request signal and consequently the motor 10 has begun to run, the current flows through the heating winding of the prepurging relay which is indicated as resistor 25, the prepurging contact 26 being open. The excitation winding 21 has a very low impedance, whereas resistor 25 has a much higher value (for example, 1 or 2 ohms as composed to 500 ohms). Under these conditions, if there is no flame, transistor 27 operates as a short-circuit. When the prepurging period has ended, resistor 25 has brought the prepurging relay to a temperature such that contact 26 closes, the prepurging ends and the resistor 25 is by-passed such that the collector current of the transistor 27, no longer limited by resistor 25, sharply increases (in practice to about 2 amperes) so as to cause the transistor 27 to oscillate. The base and the emitter of transistor 27 are connected to the oscillating circuit which is not a part of the invention and is therefore schematically indicated by block 45 of which the ignition transformer primary winding is a part, whereas element 46 is the transformer core, element 47 is the transformer secondary winding and elements 48–49 are the ignition electrodes.

The collector of transistor 27 is connected to conductor 34 on which the elements which cause the modulation of the rectified current are inserted. They are primarily capacitor 35 and resistor 36 which are connected to terminal 37, i.e. to the common ground 37 of the entire circuit, and then through conductor 38 to rectifier 17.

The apparatus is connected to the line by terminals 50 and 51 through which e.g. one phase and the neutral may enter respectively. Terminal 51 is connected to the main winding 11 of the motor through terminal 12. Terminal 50 is connected to one or more thermostats 53 and through conductor 54 to the lock out switch generaly indicated at 55. When the lock out switch is in its operating condition, as illustrated in FIG. 1, it connects the input line phase to terminal 57 and through conductor 56, to the main winding 11 of the motor. When the lock out switch is in its blocking, it connects the phase to terminal 58 and conductor 59. Conductor 59 may in turn be connected to a possible load, in general comprising a light which indicates that the device is locked out; in any event, under those conditions, the motor does not receive current, and since the other parts of the ignition device are fed through rectifier 17 by means of winding 11, they do not receive current either and therefore a situation is obtained in which the device is blocked.

In FIG. 1, the heating winding 15 of the lock out relay and lock out switch 55 are indicated as distanced from one another, but actually winding 15 is arranged around the bimetallic lamina which is a part of the lock out switch.

With reference now to FIGS. 2, 3, and 4, element 60 is the base of the ignition device which carries the suitable contacts. Element 61 is a small plate mounted on base 60 (said small plate is omitted, for the sake of clarity, in FIG. 4), which essentially carries the entire block 40 with the exception of the photoresistance. A resin body 62 is mounted on base 60 and houses the secondary winding of the transformer and is provided with two extremities 63 and 63' which are coupled to conductor bars which serve to place the secondary winding of the transformer in contact with the ignition electrodes when the device is placed in situ on the burner and therefore said extremities become inserted into the screws of the same. Element 64 is a supporting coil or reel, also made of plastic material, on which the primary winding 65 of the transformer is mounted. Supporting coil 64 is in a single body with a sleeve 66. The ferrite core or coil of the transformer which magnetically connects the primary to the secondary winding extends internally into the sleeve 66 and reaches practically its open end, as shown at 67 (FIG. 3). The bimetallic lamina 68, which constitutes the operative element of the lock out switch, is positioned immediately facing the end of sleeve 66 and therefore the end 67 of the ferrite core. The winding 15, which has been described in the electrical diagram of the circuit, is wound about the lamina. Thanks to such a position, the bimetallic lamina is heated, as has been said, both through winding 15 and by induction from the magnetic flux of the transformer.

In the position shown in the drawing, which corresponds to the circuit position of FIG. 1, the lamina 68 retains with its end 69 the swing lever 70 which is elastically loaded by the metal laminae 71 and 72. The two laminae 71 and 72 are in electrical contact, as indicated at 80 (FIG. 4). One of laminae is connected to the input line phase (such as through conductor 54 of FIG. 1) whereas the other laminae corresponds to contact 57. Under those conditions, current flows through winding 15 and the lamina 68 bends its free end 69 toward the right (i.e. looking at FIG. 4, towards the transformer). When it has sufficiently bent, the swing lever 70 is freed from its end 69 and rotates in a clockwise direction (looking at FIG. 4), i.e. in such a way that its tip which previously engaged the end 69 of the bimetallic lamina 68, is shifted downwards. Consequently, laminae 71 and 72 are left free to reach their position of elastic equilibrium and become spaced one from the other and the contact therebetween ceases, while lamina 71 comes into contact with lamina 73 which represents the terminal 58 of FIG. 1, i.e. the device reaches the blocking position. To return it back to operative position, it is necessary to manually act on a push button which presses the swing lever 74 downwards and this rotates swing lever 70, to which it is connected, in a reverse direction, i.e. in counter-clockwise direction. The bimetallic lamina 68, if it has become cooled meanwhile, goes back to the position indicated in the drawing and retains swing lever 70 and therefore all the parts indicated go back to their operative position.

The remaining parts of the device which are illustrated in the drawing figures have no relevance with respect to the present invention.

Although an embodiment of the invention has been described, in which it is applied to a certain type of ignition device, it is clear that the invention itself is applicable to any liquid fuel burner ignition device, provided that it comprises a lock out device having a bimetallic lamina or similar element and an ignition transformer.

We claim:

1. A fuel burner ignition device having an ignition transformer connected to electrodes, and having a lock out device comprising a thermal relay means and a resistive heating element for heating said relay means, said relay means controlling the flow of power to said ignition device and said heating element having a current flow which is directly related to a current flow to said electrodes;

wherein said thermal relay is arranged so as to receive at least a portion of said transformers electromagnetic flux, whereby said flux heats said thermal relay due to the parasitic current generated therein; and wherin said thermal relay is arranged so that said heating of said thermal relay by said flux at least partially compensates for variations in said heating of said thermal relay due to changes in said resistive heating element current flow which are due to changes in said current flow to said electrodes.

2. A fuel burner ignition device comprising a lock out device having a bimetallic lamina, a resistive element for heating said bimetallic lamina and an ignition transformer having a ferrite core, wherein said bimetallic lamina is arranged in such a position with respect to said resistive element and said transformer as to be heated by both said resistive element and by a parasitic current directly induced therein, said parasitic current caused by magnetic flux from said ignition transformer.

3. A device according to claim 2 wherein said bimetallic lamina is arranged so as to be physically adjacent to said transformer core.

4. A device according to claim 2, wherein said bimetallic lamina is arranged so as to be physically adjacent to an end of said ferrite core of said transformer.

5. A device according to claim 2, further comprising a feed circuit for supplying a low voltage of a low frequency and a rectifying means for transforming said low voltage into a unidirectional rectified current and for feeding said unidirectional current to a means for generating a high frequency alternating current for feeding said ignition transformer, wherein said resistive element is arranged so as to be electrically in series between said feed circuit and said rectifying means.

6. A device according to claim 2, wherein a current applied to said resistive element essentially corresponds to a current applied to said ignition transformer.

7. A device according to claim 2, wherein said resistive element is so dimensioned and said lamina is so positioned with respect to said ignition transformer core, that a time period required by said lamina to actuate said lock out device may vary as a function of the relative position of ignition electrodes connected to said transformer, said time period varying between a maximum and a minimum such that the ratio thereof does not substantially exceed 1.5.

* * * * *